US006415805B1

(12) United States Patent
Kuo

(10) Patent No.: US 6,415,805 B1
(45) Date of Patent: Jul. 9, 2002

(54) CLOSING MECHANISM USED IN A QUADRUPLE FOLDING COLLAPSIBLE UMBRELLA

(76) Inventor: Shih-Shin Kuo, 8F, No. 39, Sau Nien Street, Hsinchu (TW)

( * ) Notice: Subject to any disclaimer, the term of this patent is extended or adjusted under 35 U.S.C. 154(b) by 0 days.

(21) Appl. No.: 09/708,550

(22) Filed: Nov. 9, 2000

(51) Int. Cl.[7] ..... A45B 25/14

(52) U.S. Cl. ..... 135/22; 135/20.3; 135/24; 135/25.1; 135/28

(58) Field of Search ..... 135/15.1, 20.3, 135/22, 24, 28, 38, 39, 25.1

(56) References Cited

U.S. PATENT DOCUMENTS 2,782,795 A * 2/1957 Small ..... 135/20.3
5,029,596 A * 7/1991 Tung ..... 135/20.3
5,267,583 A * 12/1993 Wu ..... 135/24
5,390,686 A * 2/1995 Lin et al. ..... 135/24
5,441,065 A * 8/1995 Lin et al. ..... 135/24
6,016,822 A * 1/2000 Lin et al. ..... 135/24
6,129,101 A * 10/2000 Dubinsky ..... 135/20.3
6,173,721 B1 * 1/2001 Mery ..... 135/20.3 X

FOREIGN PATENT DOCUMENTS

EP 628264 * 12/1994 ..... 135/20.3

* cited by examiner

*Primary Examiner*—Carl D. Friedman
*Assistant Examiner*—Winnie Yip
(74) *Attorney, Agent, or Firm*—Rosenberg, Klein & Lee

(57) ABSTRACT

A closing mechanism used in an automatic quadruple folding collapsible umbrella is provided that comprises a pair of rollers and a round pin that cooperate with a rope to perform a closing operation. The pair of rollers is provided on one side of the umbrella runner. The round pin is disposed on the cap and orientated in the same direction as the rollers. With that mechanism, the rope extending from the interior of the umbrella rod passes to the outside through an opening in the cap to be routed around the rollers and the pin and finally tied to the cap. Thus the rope of the mechanism is longer, five times longer than the distance between the rollers and the round pin.

1 Claim, 3 Drawing Sheets

CLOSING MECHANISM USED IN A QUADRUPLE FOLDING COLLAPSIBLE UMBRELLA

BACKGROUND OF THE INVENTION

Prior art collapsible umbrellas mainly use a spring disposed inside the umbrella rod to provide urging forces to ap lunger in the umbrella rod. The plunger drives a rope, which is attached thereto, to move to preset positions to complete a closing or opening operation. Although existing designs can achieve an automatic opening and closing effect, they are complicated in structure and often malfunction because a large portion of the rope moves in the interior of the umbrella rod. Furthermore, due to the insufficient length of rope, it also often leads to a partial opening or closing of the umbrella. It is desirable to have improvements made on such a prior art closing mechanism.

SUMMARY OF THE INVENTION

In view of the above problems, the primary object of the invention is to provide an innovative closing mechanism used for a quadruple folding collapsible umbrella. According to the invention, the length of the rope is increased and a large portion of the rope is disposed outside the umbrella rod. Thus it can overcome the shortcomings of a prior art means and enhance the performance of a collapsible umbrella. Now the structure and features of het invention will be described in detail with reference to the accompanying drawings.

DESCRIPTION OF THE PREFERRED EMBODIMENT

Figure 1:
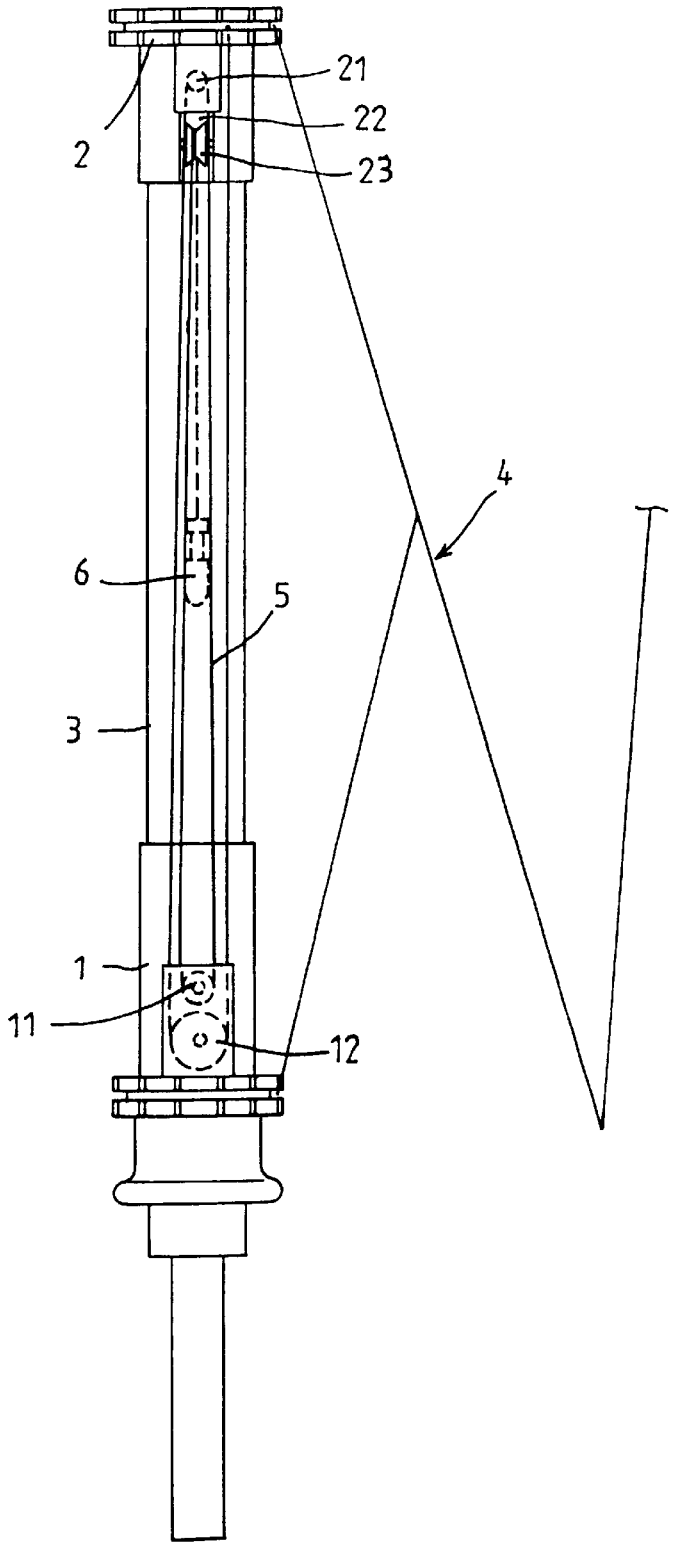
FIG. 1 is a schematic plan view showing a closing mechanism according to the invention in a closed state.
Figure 2:
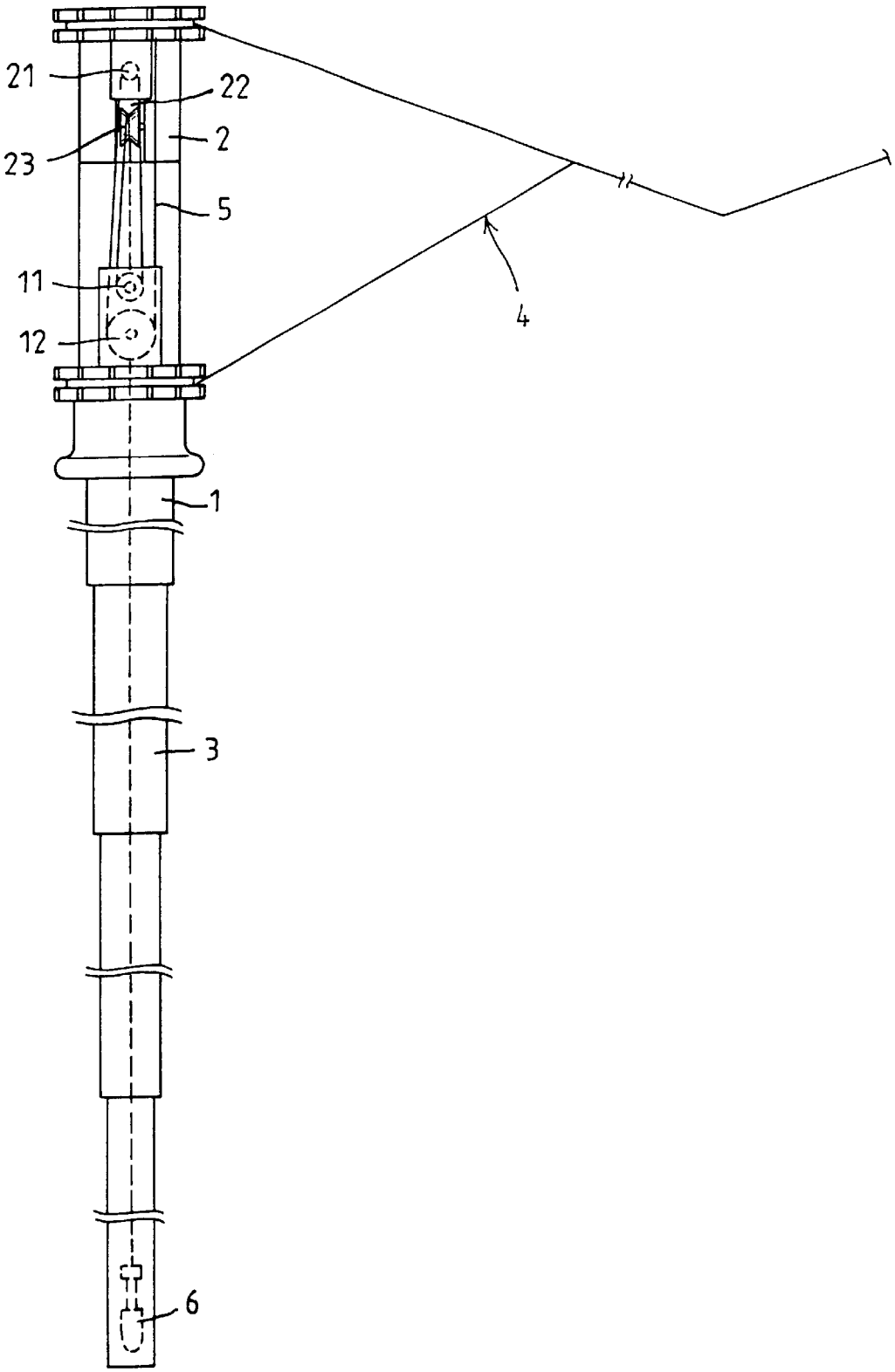
FIG. 2 is a schematic plan view showing the closing mechanism of FIG. 1 in an open state.
Figure 3:
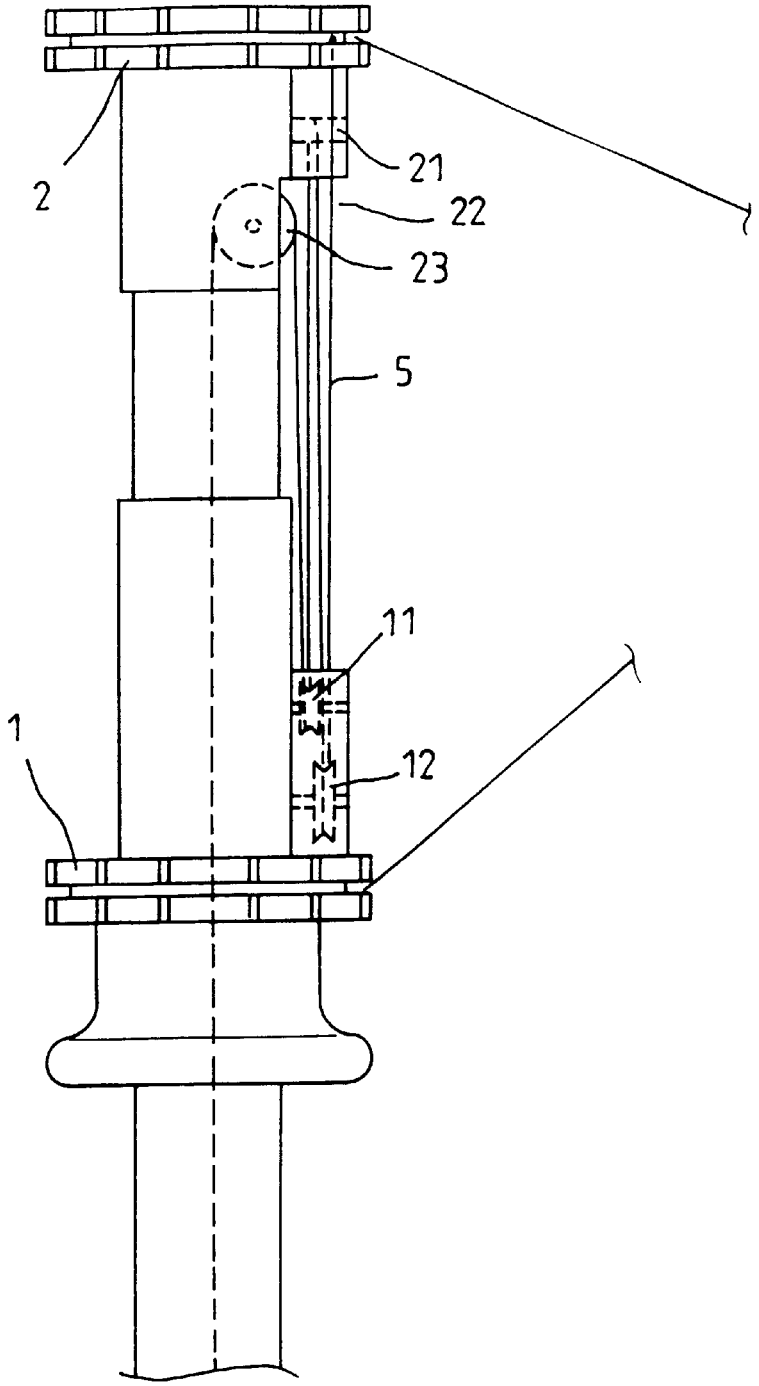
FIG. 3 is an enlarged side view showing the closing mechanism of FIG. 2.

With reference to the accompanying drawings, the invention is primarily directed to a closing mechanism used in a quadruple folding collapsible umbrella. It comprises a runner (1) slidably mounted on an umbrella rod (3), a cap (2) disposed on the top of the umbrella rod (3), a plurality of umbrella stretchers (4) linked on the inner ends to the cap (2) and the runner (1), an umbrella rod (3) housing a spring (not shown) inside, and a rope (5) attached on its inner end to a plunger (6) and extending the inner end into the interior of the umbrella rod (3). These parts are similar to those of a prior art umbrella and thus their detailed description will be omitted here.

The present invention is featured by a roller set disposed on one side of the runner (1). The roller set consists of a large roller (12) and a small roller (11). The cap (2) is provided with an opening (22) on one side thereof corresponding to the roller set. The opening (22) is in open communication with the interior of the umbrella rod (3). A round pin (21) is mounted in the cap (2) above the opening (22) and in open communication therewith. The round pin (21) is oriented in the same direction as the roller set. The rope (5) extends from the interior of the umbrella rod (3) to the outside through opening (22), passing over a cap roller (23) disposed in the opening (22), and turns at the small roller (11) first and then is wound around the round pin (21) and over the large roller (12), and then finally is tied to the cap (2). With such an arrangement, the rope extends reciprocally between these rollers and the round pin, forming more loops than in a prior art mechanism. Thus the mechanism according to the invention has a lengthened traveling distance of the plunger (6).

Through the improvements of the invention, the total length of the rope can be increased up to five times the distance between the round pin and the rollers. Therefore, using this improved mechanism in an automatic quadruple folding collapsible umbrella can provide the necessary performance for automatic operation thereof. In addition, it can also reduce the possibility of malfunction, provide convenience in manufacturing and assembling, and increase practical value because the route of the rope is arranged on the same side of the umbrella rod (3).

What is claimed is:

1. A closing mechanism for a quadruple folding collapsible umbrella, comprising:

an umbrella rod having a hollow interior;

a cap disposed on a top end of said umbrella rod, said cap having an opening formed through a side thereof and in open communication with said hollow interior of said umbrella rod;

a first roller mounted in said opening of said cap;

a runner slidably mounted on said umbrella rod;

a plurality of stretchers linked between said cap and said runner;

a roller set disposed on a side of said runner in correspondence with said opening of said cap, said roller set including a small roller and a large roller;

a round pin disposed in said cap in open communication with said opening in said cap, said round pin being oriented in correspondence with said small and large rollers;

a plunger displaceably disposed in said hollow interior of said umbrella rod; and, a rope having a first end coupled to said plunger and an opposing second end extending over said first roller and passing out through said opening in said cap, said second end of said rope passing from said first roller to wrap around said small roller and pass to said cap and wrap around said round pin, said second end of said rope passing from said round pin to said runner to wrap around said large roller and pass back to said cap for securement thereto, wherein said rope has a length approximating five times a distance between said round pin and said roller set.

* * * * *